US005820169A

United States Patent [19]

Butler et al.

[11] Patent Number: 5,820,169

[45] Date of Patent: Oct. 13, 1998

[54] APPARATUS FOR SECURING A RIBBON TO A BALLOON

[75] Inventors: Colum Butler; Ciaran Butler; Oliver Hood, all of Dublin, Ireland

[73] Assignee: Gannon Corporation Limited, Ireland

[21] Appl. No.: 716,838

[22] Filed: Sep. 19, 1996

[51] Int. Cl.[6] ..... B65H 69/04

[52] U.S. Cl. ..... 289/2; 289/17; 29/464

[58] Field of Search ..... 289/1.5, 2, 17; 446/222; 29/464

[56] References Cited

U.S. PATENT DOCUMENTS

| | | | |
|---|---|---|---|
| 4,510,653 | 4/1985 | Semanko | 446/222 |
| 4,989,906 | 2/1991 | Peverly | 289/17 |
| 5,039,142 | 8/1991 | Muma | 289/2 |
| 5,568,950 | 10/1996 | Herren | 289/17 |
| 5,611,578 | 3/1997 | Angelico, Sr. et al. | 289/17 |
| 5,647,615 | 7/1997 | Messier | 289/2 |

FOREIGN PATENT DOCUMENTS

| | | | |
|---|---|---|---|
| 2250032 | 5/1992 | United Kingdom | 289/2 |

*Primary Examiner*—David P. Bryant
*Attorney, Agent, or Firm*—Thomas M. Freiburger

[57] ABSTRACT

A method for securing a ribbon (76) to a balloon (80), having a body (84) which is in use inflated through a neck (86) is described. The method comprises the steps of retaining the body of the balloon in first retaining means (34), retaining said ribbon in second retaining means (42) spaced-apart from said first retaining means, drawing the neck of said balloon away from said first retaining means and guiding the neck around said second retaining means until the neck encircles said second retaining means and said ribbon retained in said second retaining means.

5 Claims, 2 Drawing Sheets

APPARATUS FOR SECURING A RIBBON TO A BALLOON

The present invention relates to a method and apparatus for securing a ribbon to a balloon.

According to the present invention there is provided a method for securing a ribbon to a balloon, having a body which is in use inflated through a neck, comprising the steps of: retaining the body of the balloon in first retaining means, retaining said ribbon in second retaining means spaced-apart from said first retaining means, drawing the neck of said balloon away from said first retaining means, and guiding the neck around said second retaining means until the neck encircles said second retaining means and said ribbon retained in said second retaining means.

Preferably, the ribbon projects from the second retaining means and the method comprises the step of removing the neck from the second retaining means causing the neck to contract around the projecting ribbon so that the neck retains the ribbon.

Further preferably, cutting means are provided spaced apart from said second retaining means and the method comprises the steps of drawing the ribbon from the retaining means, and cutting the ribbon on said cutting means.

According to a second aspect of the invention there is provided an apparatus for tying a balloon, having a body which is inflated through a neck, said apparatus comprising first retaining means for retaining the body of the balloon and second retaining means spaced apart from said first retaining means, so that in use the neck of the balloon can be drawn away from said first retaining means, looped around said second retaining means and withdrawn from said second retaining means to provide a tied balloon.

Figure 1:
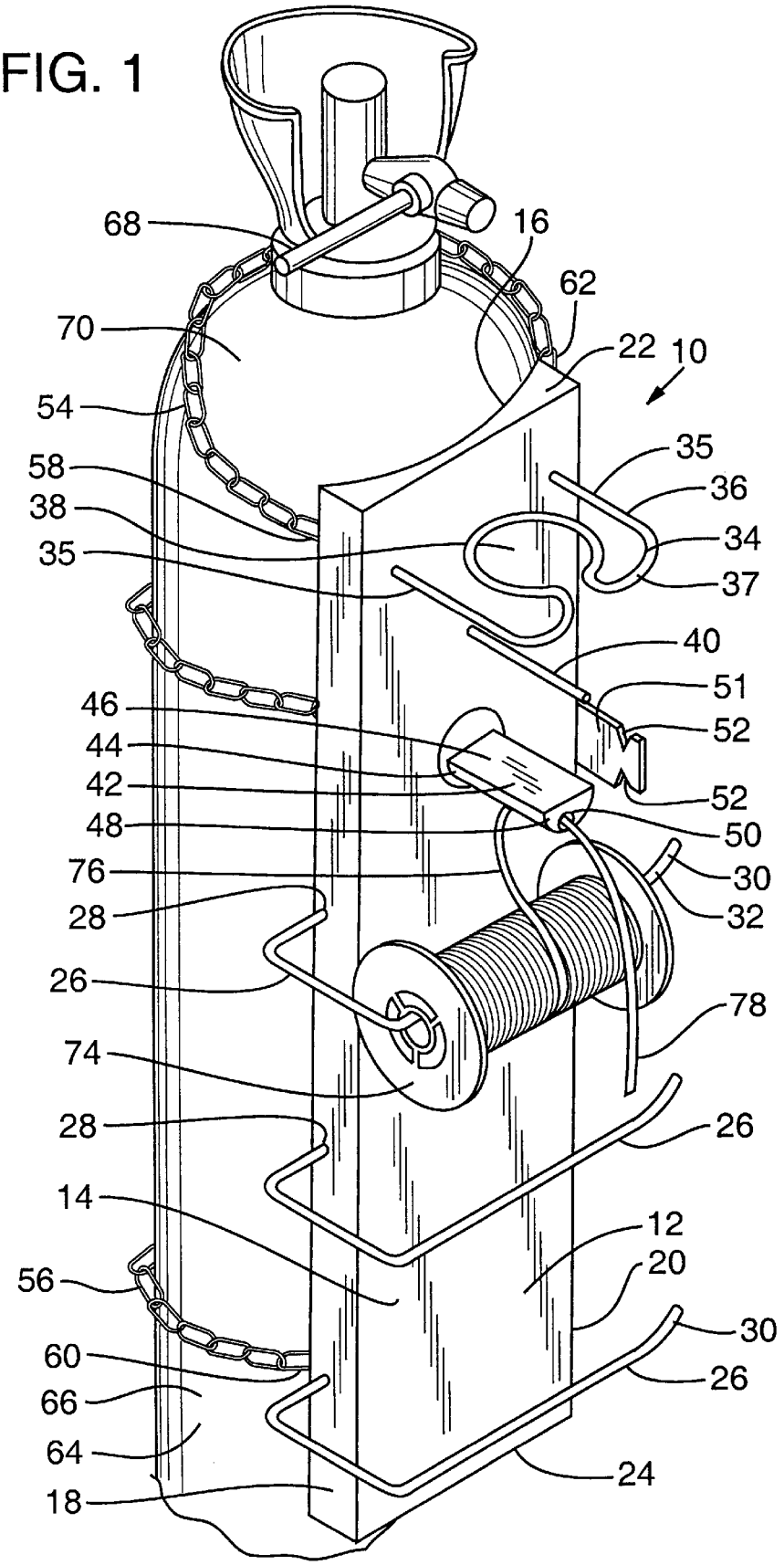
Figure 2:
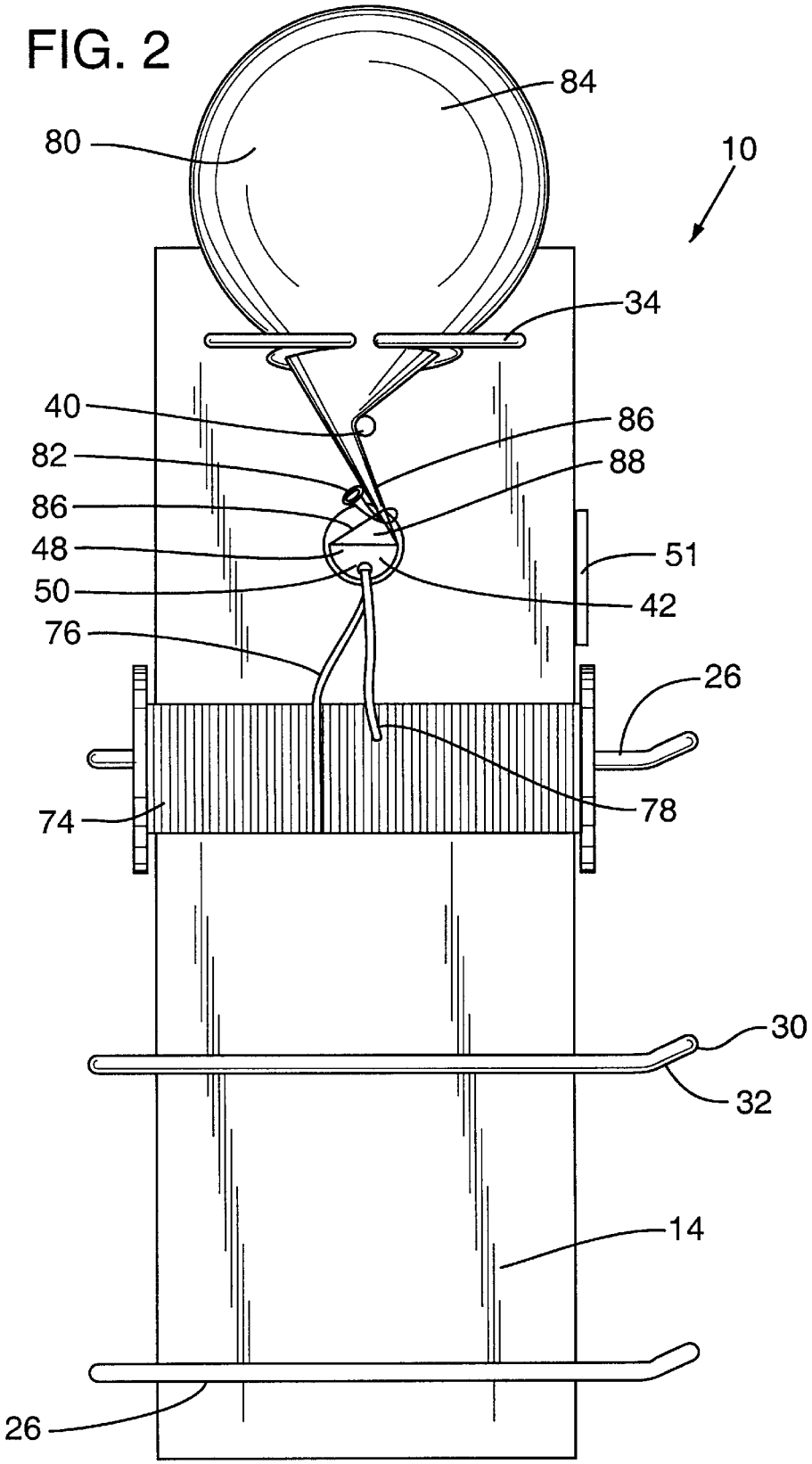

An embodiment of the invention will now be described, by way of example, with reference to the accompanying drawings, in which:

FIG. 1 is a perspective view of an apparatus for use in the method of securing a ribbon to a balloon according to the invention in situ; and FIG. 2 is a front view of the apparatus of FIG. 1 of the drawings;

Referring now to FIG. 1 of the drawings, there is shown an apparatus for securing a ribbon to a balloon generally indicated at 10 according to the invention. The apparatus 10 includes a substantially rectangular base 12 defined by a rectangular front face 14, a concave rear face 16, first and second rectangular side faces 18, 20 respectively, and first and second plano-concave end faces 22, 24 respectively.

Three substantially L-shaped spindles 26 each have a first end 28 and a free end 30. Each first end 28 is mounted to the first side face 18 of the base 12. Each spindle 26 projects from the first side face 18 and extends towards the second side face 20 along a line which is spaced-apart from and substantially parallel to the front face 14. A portion 32 of each spindle 26 adjacent the free end 30 is inclined to form an obtuse angle with the remainder of the spindle 26. The spindles 26 are mutually spaced-apart along the length of the base 12.

First retaining means in the form of a seat 34 comprises a substantially U-shaped bar 36 having two legs 35 joined by a cross-piece 37. A substantially circular indentation 38 is formed in the cross-piece 37. The legs 35 are mounted to the front face 14 of the base 12 adjacent the first end face 22.

A guide rod 40 is fixed to and projects from the front face 14 of the base 12. The guide rod 40 is located between the seat 34 and the spindles 26 and projects perpendicularly to the front face 14.

Second retaining means in the form of a substantially semi-cylindrical feeder 42 is mounted to and projects from the front face 14 of the base 12 between the guide rod 40 and the spindles 26. The feeder 42 includes a semi-cylindrical face 44, a rectangular face 46 and a semi-circular end face 48. A feed inlet (not shown) is located near the mid-point of the semi-cylindrical face 44 and a feed outlet 50 is located in the semi-circular end face 48 with a channel (not visible) formed within the feeder between the inlet and outlet.

The feeder 42 is so arranged relative to the front face 14 that the semi-cylindrical face 44 faces the spindles 26 and the rectangular face 46 faces the guide rod 40.

A rectangular cutter 51 is mounted to the second side face 20 adjacent the feeder 42. A pair of notch-shaped blades 52 are formed in opposing sides of the cutter 51.

A first and second chain 54, 56 have respective first ends 58, 60 and second ends 62 (only one visible) and are mounted to the base 12 adjacent the first and second end faces 22, 24 respectively. The respective first end 58, 60 of each chain 54, 56 is fixed to the base 12 adjacent the first side face 18. The respective second end 62 of each chain 54, 56 is fastenable to the base 12 adjacent the second side face 20.

A tank 64 includes a body 66 having a shoulder 70 from which an outlet nozzle 68 projects. Typically, the tank 64 is filled with a gas (not shown) such as helium. The nozzle 68 is openable to release the gas from the tank 64. The apparatus 10 is mountable to the tank 64 by locating the first chain 54 around the shoulder 70 and the second chain 56 around the body 66. The concave rear face 16 of the base 12 substantially conforms to the shape of the tank 64.

A reel 74 of, for example, ribbon 76 is rotatably mountable to one or each of the spindles 26. The reel 74 is threaded onto the spindle 26 so that the reel 74 is rotatable about its longitudinal axis. Lateral movement of the reel 74 relative to the spindle 26 is inhibited by the inclined portion 32 of the spindle 26.

The ribbon 76 has a loose end 78 which is fed, by an operator, through the feed inlet and along the channel until it emerges from the feed outlet 50. The loose end 78 of the ribbon hangs freely from the feed outlet 50. A sufficient length of ribbon 76 is drawn through the feed outlet 50 so that the ribbon 76 is retained by the feeder 42 under the weight of the loose end 78.

Referring now to FIG. 2, there is shown a balloon 80 comprising a mouth 82 joined to an inflatable pouch 84 by a neck 86.

In use, an operator fits the mouth 82 of the balloon 80 over the nozzle 68 of the tank 64. The operator opens the nozzle 68 thus releasing gas into the balloon 80. When the pouch 84 is filled with gas, the operator removes the mouth 82 from the nozzle 68 and pinches the neck 86 adjacent the mouth 82 to prevent gas from escaping from the balloon 80.

The operator then feeds the neck 86 of the balloon 80 through the circular indentation 38 until the pouch 84 is securely held in the seat 34. The operator draws the neck 86 away from the seat 34 and guides the mouth 82 so that the neck 86 is stretched over the guide rod 40 and around the semi-cylindrical face 44 of the feeder 42 between the feed inlet and the feed outlet 50 of the channel. Passing the neck 86 around the rod 40 expels air from the neck of the balloon allowing easier knotting of the balloon as will be explained. The mouth 82 is then wrapped around a portion of the neck 86, which is located between the guide rod 40 and the feeder 42, to form a loop 88. The mouth 82 is further fed through the loop 88 by the operator. As the ribbon 76 passes through the channel, therefore, it also passes through the loop 88.

Thus, the neck 86 simultaneously encircles the feeder 42 and a portion of the ribbon 76.

The operator removes the stretched neck 86 from the feeder 42 while maintaining the loop 88. Once the neck 86 disengages the feeder 42, the neck 86 returns to its unstretched state. The loop 88 thus contracts to form a knot (not shown). The ribbon 76 is grasped within the knot adjacent the loose end 78. The knot may be tightened by the operator pulling the mouth 82 of the balloon 80 away from the knot.

The operator removes the balloon from the seat 34 and draws the loose end 78 of the ribbon 76 away from the reel 74 thereby causing the reel 74 to rotate and ribbon 76 to be dispensed from the reel 74. When a desired length of ribbon 76 has been dispensed from the reel 74, the operator draws the ribbon 76 towards the cutter 51 and cuts the ribbon 76 to the desired length using one or other of the notch-shaped blades 52.

The spacing between the feed outlet 50 and the cutter 51 is so arranged that, after the ribbon 76 has been cut, a sufficient length of ribbon 76 hangs from the feed outlet 50 to enable the ribbon 76 to be retained by the feeder 42.

It will be seen that the embodiment provides a simple method and apparatus for securing a ribbon to a balloon where the two actions of tying the balloon and securing the balloon to the ribbon are performed simultaneously.

It will be seen that the apparatus 10 may also be used only to tie the balloon. In this case, the feeder 42 is not supplied with ribbon and the balloon is knotted when looped around and withdrawn from the feeder as described earlier.

It will be further realised that the apparatus can be mounted on the gas bottle in a variety of ways or the apparatus may be fixed to a wall with, for example, a wall mounting bracket.

The invention is not limited to the embodiments described herein which may be modified or varied without departing from the scope of the invention.

We claim:

1. An apparatus for tying a ribbon to a balloon having a body which is in use inflated through a neck, the apparatus comprising a support base, a first retaining means extending from the base for retaining the inflated body of a balloon, and second retaining means extending from the base and spaced apart from the first retaining means so that in use the neck of the balloon can be drawn away from the body of the balloon retained in the first retaining means, stretched around the second retaining means to form a loop, and fed through the loop, whereby upon removal of the neck from the second retaining means the neck contracts to form a knot, the apparatus further including a channel in the second retaining means for accommodating a ribbon, the channel having a ribbon inlet and a ribbon outlet with the ribbon inlet being disposed closer to the base than the ribbon outlet such that the length of ribbon in the channel extends generally away from the base and the neck of the balloon can be stretched around the second retaining means between the ribbon inlet and ribbon outlet, whereby upon removal of the neck from the second retaining means the neck contracts to from the knot around the ribbon.

2. An apparatus according to claim 1, wherein the second retaining means is substantially in the form of a semi-cylindrical body with a flat face facing the first retaining means and a curved face facing away from the first retaining means.

3. An apparatus according to claim 2, wherein the ribbon outlet is in a substantially semi-circular end face of the second retaining means and the ribbon inlet is in the curved face of the second retaining means.

4. An apparatus according to claim 1, further including means for supporting a reel of ribbon on the base from which reel the ribbon can be fed through the channel from the ribbon inlet to the ribbon outlet.

5. An apparatus according to claim 1, further including a guide rod projecting from the base and being positioned to deflect the neck of the balloon between the first and second retaining means.

* * * * *